US007234565B1

(12) United States Patent
Lam

(10) Patent No.: US 7,234,565 B1
(45) Date of Patent: Jun. 26, 2007

(54) CONVERTIBLE LIFT ASSEMBLY

(75) Inventor: Hong Lam, Thornhill (CA)

(73) Assignee: Thomson & Leonard, Thornhill (CA)

( * ) Notice: Subject to any disclaimer, the term of this patent is extended or adjusted under 35 U.S.C. 154(b) by 2 days.

(21) Appl. No.: 11/305,119

(22) Filed: Dec. 19, 2005

(51) Int. Cl.
*B66B 9/08* (2006.01)

(52) U.S. Cl. ..... 187/200; 187/201; 182/141

(58) Field of Classification Search ..... 187/200, 187/201; 198/326, 331; 182/141
See application file for complete search history.

(56) References Cited

U.S. PATENT DOCUMENTS

| | | | | |
|---|---|---|---|---|
| 4,124,097 | A | 11/1978 | Hawks et al. | |
| 4,168,134 | A | 9/1979 | Pohl | |
| 4,273,217 | A * | 6/1981 | Kajita | 414/556 |
| 4,285,416 | A | 8/1981 | Dudynskyj | |
| 4,457,402 | A | 7/1984 | Del Vecchio et al. | |
| 4,643,273 | A | 2/1987 | Stokoe | |
| 4,919,236 | A | 4/1990 | Karlsson et al. | |
| 5,142,991 | A | 9/1992 | Theis | |
| 5,224,723 | A | 7/1993 | Hatas | |
| 5,234,078 | A | 8/1993 | Smith | |
| 5,632,357 | A | 5/1997 | Matre | |
| 5,901,812 | A | 5/1999 | Meunier | |
| 5,937,971 | A | 8/1999 | Storm | |
| 6,050,366 | A * | 4/2000 | Lyons | 187/200 |
| 6,109,395 | A * | 8/2000 | Storm | 187/200 |
| 6,601,677 | B1 | 8/2003 | Storm | |
| 6,679,353 | B1 | 1/2004 | Muranaka | |

OTHER PUBLICATIONS

Wheelchair Porch Lift, Residential Home Wheelchair Electric Porch Lifts; www.handiramp.com/50_lifts.htm, Jun. 14, 2004; 3 pages.
Access Industries; www.accessind.com/portable.html, Jun. 14, 2004; 4 pages.
Access Industries; www.accessind.com/portable_specs.html; Jul. 21, 2004; 1 page.
Liberator—Vertical Platform Lift from Concord Elevators & Lifts—Brampton, Ontario; www.concordelevator.com/liberator-lift.htm, Jun. 14, 2004; 1 page.
Vertical Home Lift, Mac's Lift Gate Inc.; www.macslift.com/porch_lifts/index.html, Jun. 13, 2004; 3 pages.
Wheelchair Porch Lifts—Elevators For Handicapped; www.accessinc.com/wheelchair_porch_lifts.htm, Jun. 14, 2004; 5 pages.

* cited by examiner

*Primary Examiner*—Gene O. Crawford
*Assistant Examiner*—Terrell Matthews
(74) *Attorney, Agent, or Firm*—Gowan Intellectual Property

(57) ABSTRACT

A convertible lift assembly is provided in which a vertical lift can be reversibly converted into a set of stairs. The assembly of the present invention uses less space than prior art system, and utilizes a set of movable side panels that can be contracted or extended to provide resting points for a series of stair panels. When in a contracted position, the side panels provide resting points in a stair configuration for the stair panels. When in an extended position, the stair panels are collected on a frame to provide an essentially flat, horizontal platform that can be raised or lowered on a movable frame.

15 Claims, 5 Drawing Sheets

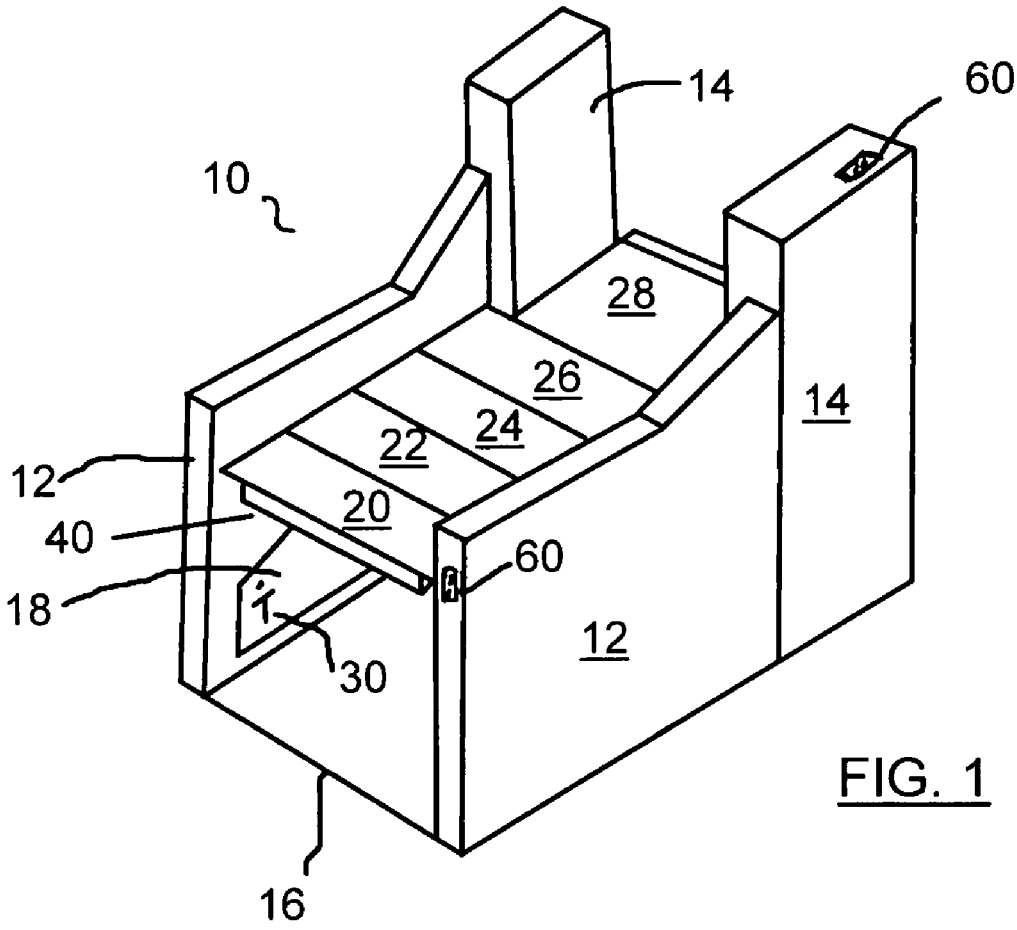
FIG. 1
FIG. 2
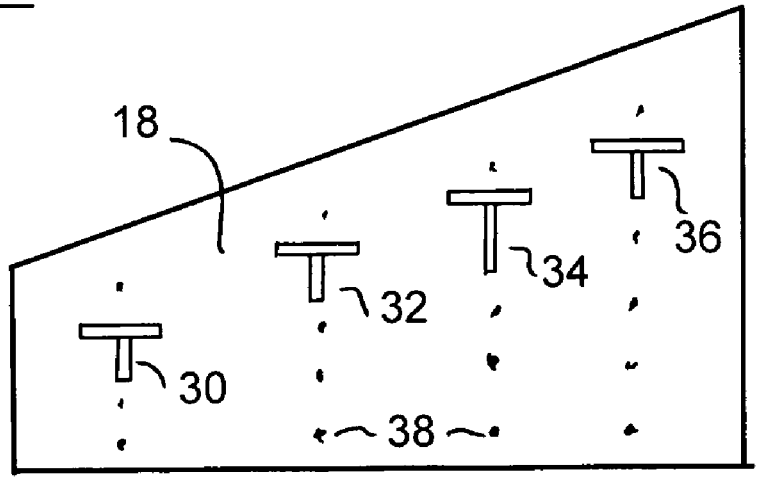

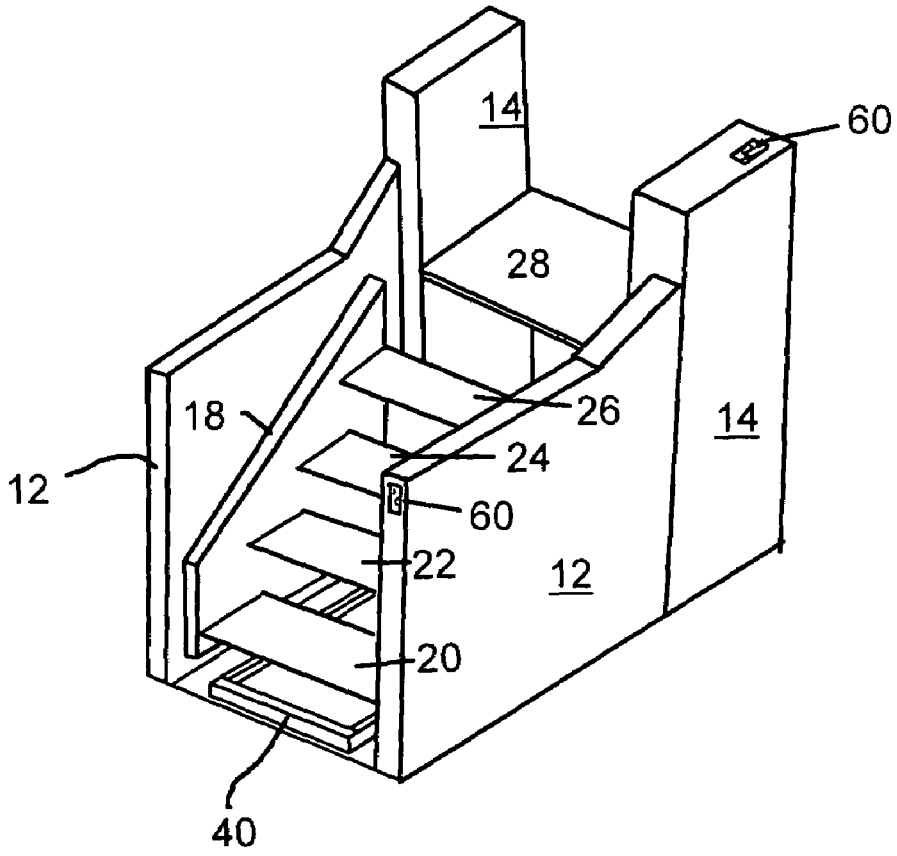
FIG. 5
FIG. 6
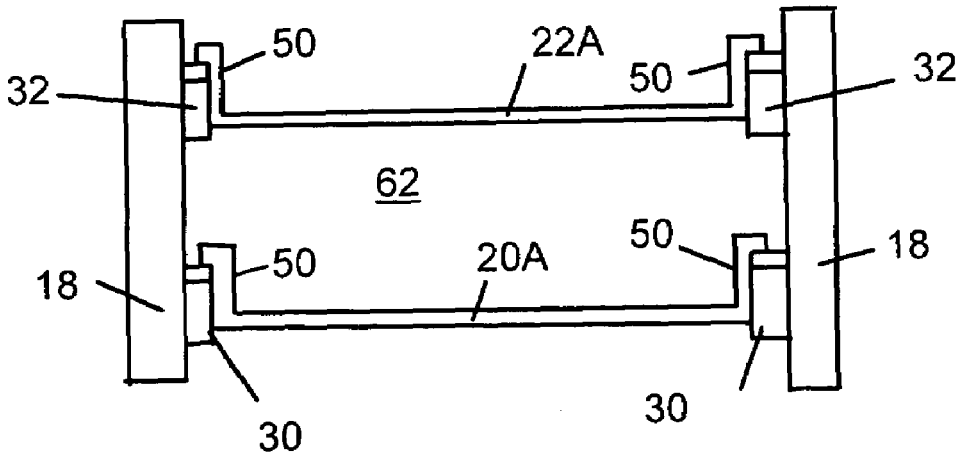

CONVERTIBLE LIFT ASSEMBLY

FIELD OF THE INVENTION

The present invention relates generally to the field of vertical lifts, and in particular, to lift mechanisms that convert to stairs.

BACKGROUND OF THE INVENTION

Stairways employed in buildings and other structures present difficulties to non-ambulatory individuals. For example, a non-ambulatory individual confined to a personal vehicle such as a wheelchair cannot easily negotiate common stairwells. To accommodate such individuals, separate elevator lifts, moving chair arrangements, or ramps are often provided. In stair structures extending a vertical distance that is less than a building story, such as those typically used near the entrance to a building, a separate elevator lift is not always practical, particularly in outdoor environments. In such cases, separate ramps or moving chair arrangements may be provided which facilitate vertical travel by a personal vehicle.

One drawback to the use of a separate ramp to provide personal vehicle access to elevated surfaces is that suitable ramps consume relatively large amounts of space. As a result, existing buildings must often be substantially altered to accommodate the installation of a ramp. In many circumstances, space constraints within or surrounding the building make installation of a ramp impossible.

Moving chair arrangements offer a solution in such low rise environments. Moving chair arrangements comprise a chair that slides diagonally up and down the stairway. Such arrangements require that the personal vehicle be separately transported up or down the stairway. Because personal vehicles can be quite heavy, separate transport of the personal vehicle can be difficult. Moreover, the movable chair itself, when not in use, still occupies stairway space and thus dictates the appearance of the staircase.

Separate vertical wheelchair lifts have also been employed for such low rise environments for use in situations in which there is inadequate room for an access ramp. Such devices, however, while consuming less space than a ramp, nevertheless consume valuable access space and dictate certain architectural parameters. Moreover, separate wheelchair lifts may be impossible to implement in hallways or other narrow environments.

In an attempt to address some of the concerns of the separate vertical lift, lifts have been developed that cooperate with a staircase to provide a vertical lift that fits within a hallway or narrow environment. For example, U.S. Pat. No. 4,457,402 to Del Vecchio et al. shows a lift that is disposed directly in front of a low rise staircase that extends from a lower surface to an upper surface. The lift provides vertical transport of wheelchairs from the lower surface to the level of the upper surface. When the lift rises, the stairs collapse upward to form a bridge platform that allows travel from the lift platform over the area normally occupied by the staircase to the destination upper surface.

Another proposed design of a lift that may be located in a narrow environment is found in U.S. Pat. No. 5,234,078 to Smith. In the Smith patent, a lift platform is located on the upper surface directly behind the ascending stairs. In other words, the lift platform forms a portion of the upper surface. The lift platform provides transport between the upper surface and the lower surface through vertical movement. When the lift platform lowers to the level of the lower surface, the stairs collapse so that they too are substantially on the level of the lower surface. When the lift platforms rises to the level of the upper surface, the stairs reconfigure into a staircase.

A drawback of the designs found in the Del Vecchio et al. and Smith patents discussed above is that they require space equivalent to the area of the lift platform either completely in front of or completely behind the staircase. In some cases, such area is not available. Moreover, because the lift platform is located completely outside the footprint of the staircase, the lift platform creates a potentially displeasing architectural discontinuity with the surface at which it normally rests while not in operation. For example, as shown in FIG. 1 of the Smith patent, the lift structure requires special wall and floor structures that create visible discontinuities along the floor and wall. Likewise, the lift shown in the Del Vecchio et al. patent, undesirable creates a plainly visible discontinuity along the intersection of the platform and lower (ground) surface. Such discontinuities significantly affect the appearance of an architectural structure.

These issues were addressed by Storm in U.S. Pat. No. 5,937,971, in which a rotating rail system is used to create, in one configuration, a flat platform, which can be moved up or down, and in a second configuration, an angled stairway. While this design provided a convertible lift mechanism that could be fitted within a smaller space than the Del Vecchio or Smith patents, it's rail system provides poor support for the platform, and requires a complex system for movement of the rails and/or platform, and is not readily convertible for providing staircases of different heights. As such, each must be custom design for a particular location, or the building must be architecturally modified to meet the design parameters of a standard staircase. Further, there is no apparent mechanism for adjustment of the stair height to comply with various local building regulations, or the like.

As such, there continues to exists a need, therefore, for a improved lift structure which is convertible from stairs to a moving platform, in order to provide access between a lower surface and an upper surface. The design must continue to provide a convertible lift assembly that has reduced impact on the architectural and/or design aspects of a structure, and which may be employed in structures with space constraints.

SUMMARY OF THE INVENTION

Accordingly, it is a principal advantage of the present invention to provide a convertible lift assembly that partially or fully meets the goals and objectives set out hereinabove. These advantages, as well as other objects and goals inherent thereto, are at least partially or fully provided by the convertible lift assembly of the present invention, as set out hereinbelow.

In particular, the present invention fulfills the above need, as well as others, by providing a convertible lift assembly that provides a raisable frame that moves within a space defined by two moveable side panels. When the side panels are moved towards one another, they provide resting points, in a stair-like shape, that each collect one of a series of flat stair panels that act as steps when the raisable frame is lowered. When the raisable frame is raised, it again collects the stair panels from the resting points, so that they provide a horizontally flat platform.

When the side panels are moved away from each other, the raisable frame can be raised and lowered without the stair panels meeting with their respective resting points. As a result, the flat platform remains intact as a flat platform as the raisable frame is raised and lowered.

Using this configuration provides a flat platform that does not need to be implemented as a totally separate structure that both occupies additional space and impinges upon the architectural integrity of a structure. Instead, the convertible lift assembly of the present invention includes a flat, raisable platform that occupies the space that is otherwise occupied by the staircase, and therefore requires little or no additional space.

Accordingly, in one embodiment, the present invention provides a convertible lift assembly comprising;

a raisable frame which can be moved between a raised and lowered position;

a flat platform resting on said raisable frame when said raisable frame is in said raised position, and wherein said flat platform comprises at least two stair panels;

a first side panel and a second side panel, with at least one of said first or second side panels being moveable between an extended position, to a contracted position, by movement of at least one side panel towards or away from said second side panel;

a first motive device for movement of said raisable frame;

a second motive device for movement of at least one side panel;

a support structure for supporting said raisable frame, said side panels and said first and second motive devices; and, a plurality of resting points on said side panels on which said stair panels rest when said raisable platform is lowered while said side panels are in said contracted position, wherein said stair panels have a length which is less than the distance between corresponding resting points on said side panels when said side panels are in said extended position, and a length which is greater than the distance between corresponding resting points on said side panels when said side panels are in said contracted position.

Preferably both side panels are each movable towards or away from one another.

In operation, the essentially flat stair panels rest on the raisable frame in an essentially horizontally flat platform configuration, when the side panels are in their extended position. In this configuration, the raisable frame can be raised and lowered and the stair panels will remain flat on the raisable frame since they do not interact with the side panels.

However, when the raisable frame is in its raised position, at least one, and more preferably both, side panels can be moved towards each other in order to be positioned in a contracted position. In this position, the raisable frame is still able to be lowered between the side panels, but the stair panels will be caught by, and come to rest on, the resting points that are provided on the side panels. This prevents the stair panel from being lowered further. As such, the stair panel will become separated from the raisable frame. When the raisable frame is completely lowered, one or more stair panels will remain on the side panel resting points in a stair-like configuration.

The stairs can then be used in a normal fashion while in this configuration.

To convert the stair configuration back to a platform configuration, the raisable frame is moved to a raised position in order to collect all of the stair panels off of their resting points, and again establish an essentially flat horizontal platform. With the stair panels off of the side panels, the side panels can then be returned to their extended position. The platform can then be used as previously described.

The raisable platform and moveable side panels are moved by an appropriate first or second motive forces. This is typically achieved through the use of at least one electric motor, although other motorized power sources, as motive forces, can be utilized, as will be clear to those skilled in the art.

BRIEF DESCRIPTION OF THE DRAWINGS

Embodiments of this invention will now be described by way of example only in association with the accompanying drawings in which:

FIG. 1 is a perspective view of an embodiment of the present invention wherein it is in a raised platform configuration;

FIG. 2 is a side view of a side panel used in the embodiment of FIG. 1;

FIG. 4A to FIG. 4D are a series of front views showing the movement of the side panels and the raisable frame;

FIG. 5 is a perspective view of the embodiment of FIG. 1 in a stair configuration;

FIG. 6 is a front view of an alternative arrangement of the stair panels.

DETAILED DESCRIPTION OF THE PREFERRED EMBODIMENTS

Figure 3:
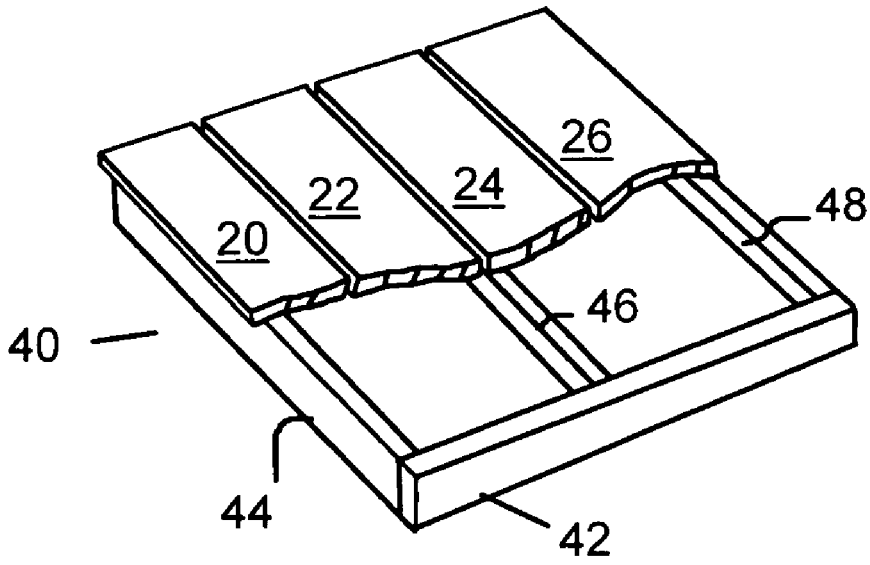
FIG. 3 is a perspective view of the raisable frame together with cut-away view of the stair panels.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a convertible lift assembly 10 is shown having a base 16, two side modules 12 and two end modules 14, which are located on either side of base 16. Between end modules 14 is a stationary platform 28, and between side modules 12 are a series of essentially flat stair panels 20, 22, 24 and 26 which in this configuration form a flat platform level with, and adjacent to stationary platform 28. Panels 20, 22, 24 and 26 all rest on a frame 40, which frame 40 is capable of movement up or down in response from input from either of controllers 60. On the interior side of side modules 12 is a movable side panel 18 having stair panel resting points 30, 32, 34 and 36, as shown in FIG. 2 which is a side view of one side panel 18. The side panel 18 on the opposite side of assembly 10 will be a mirror image of this side panel.

Resting points 30, 32, 34 and 36 correspond with, and are positioned to operatively mate with stair panels 20, 22, 24 and 26 respectively. Resting points 30, 32, 34 and 36 are T-shaped and can be bolted to side panel 18 in the appropriate location, using bolt holes 38, to provide the desired stair height and/or location. A number of bolt holes 38 are provided for each resting point, and these bolt holes 38, for a particular resting point, are vertically aligned so that they, and the respective resting point, will be positioned in the same relative position with respect to the stair panel.

Other shapes and sizes for the resting points can be used, such as rectangular, square, triangular, or circular can be used to fit into a corresponding flat, triangular or circular portion at the edge of the stair panels. Also, the resting points can be a collection of pins extending from the side panels. However, the T-shaped configuration is a preferred arrangement since it provides adequate strength properties, together with ease of attachment.

Further, while side panels 18 are preferably solid panels, they can be replaced with a frame structure that moves the resting points closer together or apart as necessary. In an extreme variation, side panels 18 can be a series of solenoids that merely move resting points 30, 32, 34 and 36 to their contracted or extended position. However, for strength and safety considerations, the sold panel configuration shown in FIG. 2 is preferred.

It will be noted that convertible lift assembly 10 is shown with 4 movable stair panels, however, those skilled in the art will readily appreciate that any number of movable stair panels can be provided in order to produce the desired number of stairs, when the assembly is used in the stair configuration. Preferably, the number of stairs provided is between 1 and 10, and more preferably between 2 and 5.

Also, the present design is adaptable to provide a reduced number of stairs in configurations wherein fewer stairs are required. For example, resting points 30 and 32 might be removed altogether, and resting points 34 and 36 lowered to provide a two stair configuration. During installation of assembly 10, stationary platform 28 would be lowered as necessary to be adjacent to panel 26 when it was resting on frame 40 in the raised position.

Frame 40 is shown in FIG. 3 comprising 2 side rails 42, with 3 cross members 44, 46 and 48. In this design, frame 40 is narrower than the width of stair panels 20, 22, 24 and 26 for the correct operation of the device. The design of frame 40 can vary depending on the intended application, or the like. For example, frame 40 can be manufactured wider than shown in the drawings, and having gaps, channels, spaces or the like, through which the various resting points can pass as the frame is raised or lowered.

Frame 40 is connected to a motor (not shown) capable of raising or lowering the frame with the additional weight from, or that has been placed on, stair panels 20, 22, 24 and 26. The motor can be, for example, placed between end modules 14, and under stationary platform 28, and can be operatively connected to frame 40 by attachment to, for example frame cross member 48, or the like.

The connection of frame 40 to the motor can be achieved in a number of different fashions known to those skilled in the art, but the connection must sufficiently strong than frame 40 can be raised and lowered in an essentially flat orientation, without excessive bending of frame 40.

The operational details of the various moving components of convertible lift assembly 10 are shown in FIGS. 4A to 4D.

Figure 4A:
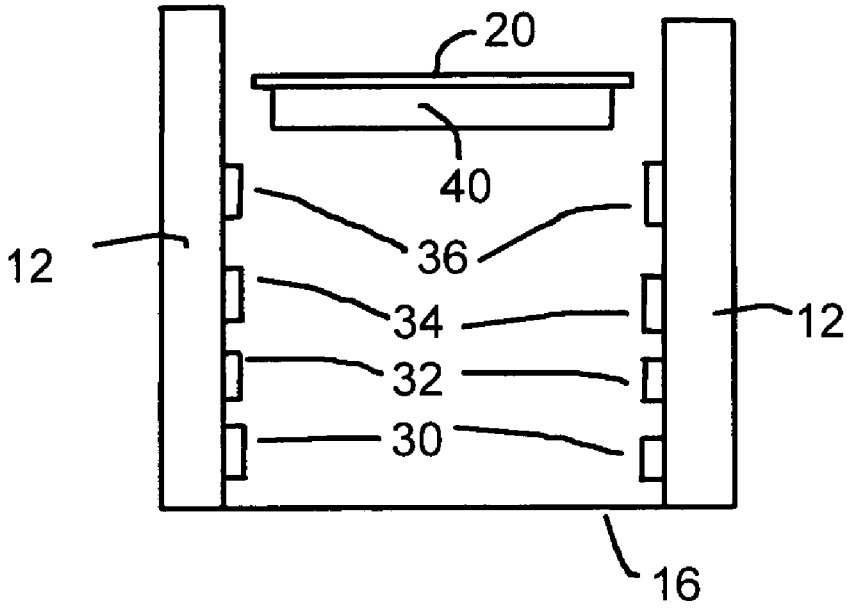
Figure 4C:
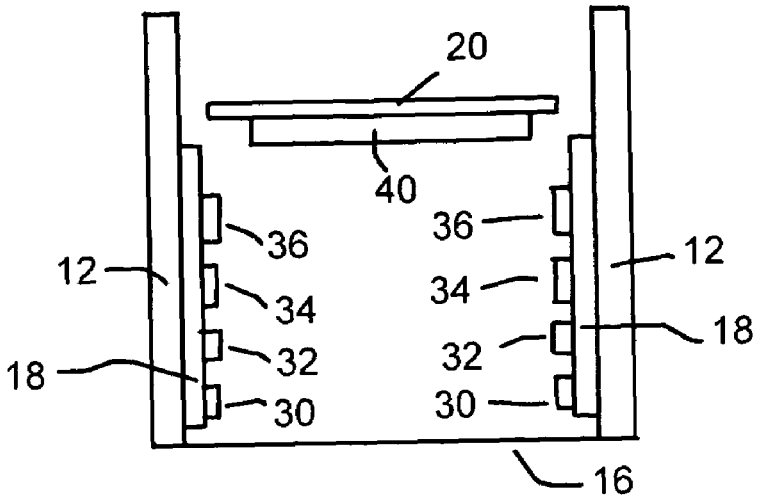
Figure 4D:
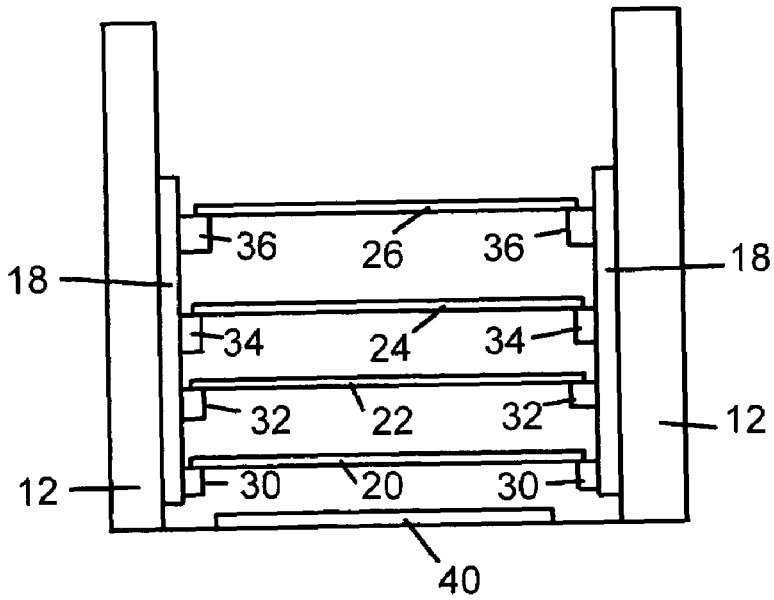

In FIG. 4A, all of the stair panels 20, 22, 24 and 26 are resting on frame 40 in a raised position which provides a flat platform adjacent to stationary platform 28 so that a user of the device, can walk out on to, or move a wheelchair, for example, to a position resting of stair panels 20, 22, 24 and 26.

Side panels 18 are in an extended position wherein they are positioned within side modules 12. Resting points 30, 32, 34 and 36 can be seen, but it is to be noted that the distance between corresponding resting points 30, 32, 34 and 36 is greater than the length of stair panels 20, 22, 24 and 26.

From this configuration, frame 40 can be lowered, in response to a command from either upper or lower controller 60 to the position shown in FIG. 4B wherein frame 40 is essentially resting on base 16 so that stair panels 20, 22, 24 and 26 are essentially level with the ground, or level with a small ramp (not shown) to facilitate entry and/or exit from assembly 10.

In use, in the configuration, the user is able to, for example, roll a wheelchair onto the platform formed by stair panels 20, 22, 24 and 26, and the platform can be raised or lowered, depending on the desired action. The platform will be raised or lowered as a flat platform, and the user will be able to exit the assembly in the raised or lowered configuration.

Various safety features (not shown) can be provided such as side bar, hand rails, end bars, or the like to prevent accidental movement of the user as the platform is raised or lowered, or to prevent the user from accidentally rolling or falling over the end of the raised platform.

To convert to the stair configuration, raisable frame 40 and all stair panels are moved to a raised position. Side panels 18 are then moved, by a motorized device for example, to a contracted position wherein they protrude inwardly from side modules 12. In the contracted position, the distance between most of side panels 18 is greater than the length of stair panels 20, 22, 24 and 26. However, the distance between corresponding resting points 30, 32, 34 and 36 is now less than the length of stair panels 20, 22, 24 and 26. Further, the width of frame 40 is less than the distance between resting points 30, 32, 34 and 36 so that frame 40 is able to move up and down without interference from any resting points 30, 32, 34 and 36.

Once side panels 18 are in the contracted position, frame 40 is lowered. As it moves to the lower position, stair panels 20, 22, 24 and 26 come to rest on their corresponding resting points, i.e. resting points 30, 32, 34 and 36 respectively. When frame 40 reaches ground level, all of the stair panels are in position, on their resting points, in a stair configuration. This is best seen in FIG. 5. When left in this position, anyone wishing to move from one level to another, can use the convertible lift assembly 10 as a normal set of stair.

To convert the stair configuration back to a platform configuration, frame 40 is raised using a motorized power source and as it is raised, collects stair panels 20, 22, 24 and 26, in that order, in order to re-create the flat platform resting on frame 40. Once frame 40 is in its raised position, side panels 18 are moved to their extended position so that frame 40 can be raised and lowered and stair panels 20, 22, 24 and 26 will again remain on frame 40. The essentially flat horizontal platform can then be used as previously described.

While not shown in detail, it will be clear to those skilled in the art that other safety features can be incorporated into the design of the present invention. These include, for example, safety interlocks to prevent side panels 18 from being moved unless frame 40 is in a raised position. Additionally, locking mechanisms such as protruding pins on resting points 30, 32, 34 and 36 can be provided that extend into corresponding holes on stair panels 20, 22, 24 and 26 so as to prevent the stair panels from moving. Electronic sensors can be provided to ensure that the pins are in place when the convertible lift assembly is in the stair configuration.

Other safety features can be incorporated as desired by the operator.

In FIG. 6, an alternative arrangement for the stair panels is provided and these panels are designated as panels 20A and 22A. These stair panels are essentially flat in their central area, but have a raised side section 50 which rests on the resting points. However, when the stair panels 20A and the like are all positioned on frame 40 in the platform configuration, raised side sections 50 provide a side ledge to prevent accidental movement of a user, or a wheelchair, or the like, off the side of the platform.

Also, other design features, such as face plates 62 can be provided which are attached to the front surface of any or all stairs panels to reduce access to the area under the stairs, or to provide a cleaner appearance to while in the stair configuration. These face plates 62 are positioned to as to side into frame 40 as it is being raised or lowered, and not otherwise interfere with the operation of the convertible lift assembly.

Figure 7A:
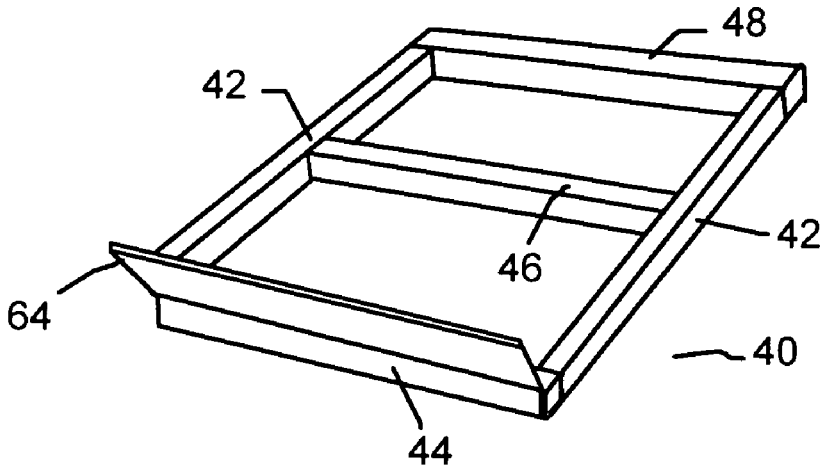
FIGS. 7A and 7B shown a ramp section fitted to the front of the frame.
Figure 7B:
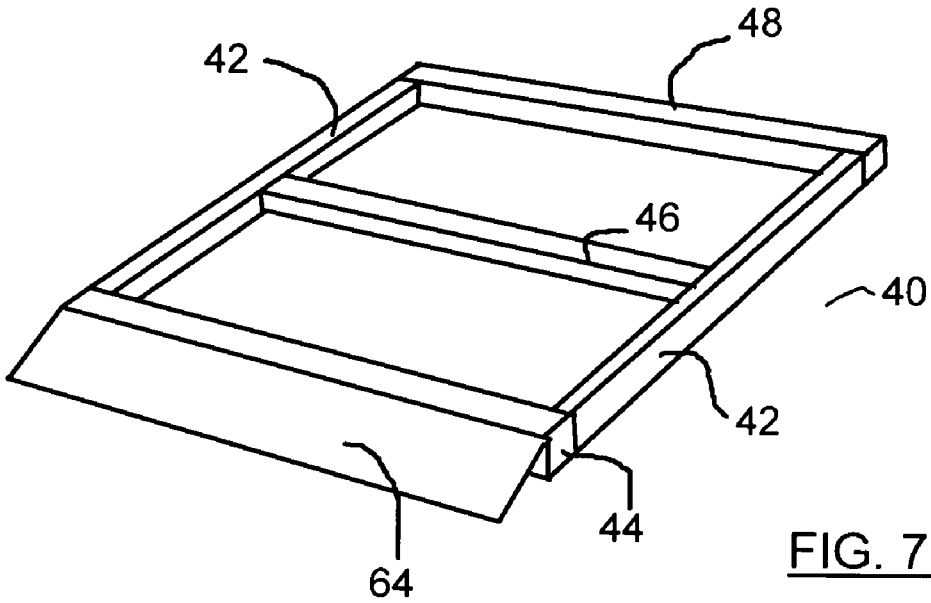

Further frame 40 can be equipped with a movable ramp section 64, shown in FIG. 7A which can be moved, by a suitable additional motive force, to a raised position to prevent a user from accidentally moving off of the platform, when the platform is above ground level, and moved to a lowered position shown in FIG. 7B which will act as a small ramp, to facilitate entry of a wheelchair, for example, onto the platform when the frame 40 is in a lowered position.

In a further aspect, the present invention also provides an improved method for lifting a person or an object, such as a wheelchair or other personal vehicle, from a lower surface to an upper surface, using the device of the present invention.

As discussed above, it is to be noted that the prior art solutions required a substantial amount of additional space to provide facilities for non-ambulatory persons. Not only were the additional space requirements difficult and some times impossible to accommodate at all, even when accommodation was possible, the prior art devices often required alteration of the architectural structure of a facility. By contrast, the method and apparatus of the present invention employs the same footprint for both the stairs and the alternative facilities by converting one or more stairs to a lift platform. The resulting structure has the advantage of requiring substantially less space.

It is also to be noted that the motorized power sources and the linkages used to move the side panels or the raisable frame have not been detailed in the present application. While the source of motorized power sources in the above described embodiment is preferably one or more electric motors, other forms of motive power may be employed. In particular, for lifting the frame, these include systems such as a hydraulic lift system power source, a pneumatic piston system power source, and the like. Also, combinations of any of these motorized power sources can be utilized, or, through the selection of appropriate linkages and the like, a single motor can act as both the first and second motive power sources. However, it is clear that those of ordinary skill in the art may readily determine the appropriate type and number of motorized power source, and the appropriated linkage configurations required for a particular implementation.

Thus, it is apparent that there has been provided, in accordance with the present invention, a convertible lift assembly which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., "substantially planar", or "essentially planar" is intended to mean planar, nearly planar and/or exhibiting characteristics associated with a planar element.

Also, while this discussion has addressed prior art known to the inventor, it is not an admission that all art discussed is citable against the present application.

I claim:

1. A convertible lift assembly comprising;

a raisable frame which can be moved between a raised and lowered position;

a flat platform resting on said raisable frame when said raisable frame is in said raised position, wherein said flat platform comprises at least two separate stair panels;

a first side panel and a second side panel, with at least one of said first or second side panels being reversibly moveable between an extended position, to a contracted position, by movement of at least one side panel towards or away from said second side panel;

a first motive device for movement of said raisable frame;

a second motive device for movement of at least one side panel;

a support structure for supporting said raisable frame, said side panels and said first and second motive devices; and, a plurality of resting points on said side panels, on which said stair panels rest when said raisable platform is lowered when said side panels are in said contracted position, and wherein said stair panels have a length which is less than the distance between corresponding resting points on said side panels when said side panels are in said extended position, and a length which is greater than the distance between corresponding resting points on said side panels when said side panels are in said contracted position.

2. A convertible lift assembly as claimed in claim 1 wherein both side panels are each movable towards or away from one another.

3. A convertible lift assembly as claimed in claim 1 wherein said essentially flat stair panels rest on the raisable frame in an essentially horizontally flat platform configuration, when the side panels are in their extended position.

4. A convertible lift assembly as claimed in claim 3 wherein said raisable frame can be raised and lowered and the stair panels will remain flat on the raisable frame, when said side panels are in their extended position.

5. A convertible lift assembly as claimed in claim 1 wherein said stair panels will be caught by, and come to rest on, said resting points, when said raisable frame is lowered from said raised position when said side panels are in their contracted position.

6. A convertible lift assembly as claimed in claim 5 wherein said stair panels form a stair-like configuration when resting on said resting points.

7. A convertible lift assembly as claimed in claim 6 comprising between 1 and 10 stairs.

8. A convertible lift assembly as claimed in claim 6 comprising between 2 and 5 stairs.

9. A convertible lift assembly as claimed in claim 1 wherein said resting points are T-shaped and are bolt to said side panels using one or more bolt holes in order to provide the desired stair height and/or location.

10. A convertible lift assembly as claimed in claim 9 wherein a series of bolt holes is provided which are vertically aligned so that the position of said resting point can be adjusted on said side panel.

11. A convertible lift assembly as claimed in claim 1 wherein said first or second motive devices are each an electric motor, a hydraulic lift system power source, a pneumatic piston system power source, or combinations thereof.

12. A convertible lift assembly as claimed in claim 11 wherein a single motor acts as both said first and second motive devices.

13. A convertible lift assembly as claimed in claim 1 additionally comprising one or more safety features selected from the group of side bars, hand rails, end bars, safety interlocks, locking mechanisms, or electronic sensors.

14. A convertible lift assembly as claimed in claim 1 wherein said stair panels have an essentially flat central section with a raised side section which rests on said resting points.

15. A convertible lift assembly as claimed in claim 1 additionally comprising a movable ramp section which can be moved to a raised position to prevent a user from accidentally moving off of the platform, when the platform is above ground level, and moved to a lowered position wherein it will act as a ramp, to facilitate entry onto the platform when said frame is in a lowered position.

* * * * *